United States Patent [19]

Spruill

[11] 4,126,285

[45] Nov. 21, 1978

[54] WINDING REEL

[76] Inventor: Robert E. Spruill, 4201 Portchester Way, Decatur, Ga. 30034

[21] Appl. No.: 785,493

[22] Filed: Apr. 7, 1977

[51] Int. Cl.[2] ..... B65H 75/06

[52] U.S. Cl. ..... 242/222

[58] Field of Search ..... 242/222, 61; 206/396, 206/491, 49, 395; 229/39 R, 44 R

[56] References Cited

U.S. PATENT DOCUMENTS

| | | | |
|---|---|---|---|
| 1,012,267 | 12/1911 | Motz | 242/222 |
| 2,973,858 | 3/1961 | Laneve et al. | 206/396 |
| 3,343,665 | 9/1967 | Marino | 242/222 |
| 3,383,028 | 5/1968 | Brander | 206/491 |
| 3,586,233 | 6/1971 | McCulloch | 229/44 R |
| 3,780,855 | 12/1973 | McLeod et al. | 242/222 |
| 3,958,778 | 5/1976 | Lawson | 242/222 |
| 4,017,019 | 4/1977 | Booth | 229/39 R |

*Primary Examiner*—George F. Mautz
*Attorney, Agent, or Firm*—James A. Hinkle

[57] ABSTRACT

A one-piece winding reel for fabric made from corrugated cardboard in which the corrugations are aligned with the center line of the reel. In one embodiment self-locking end-flaps are provided to eliminate the need for fastening materials. In a second embodiment the end-flaps are permanently affixed to the structure in an alternative securing means.

3 Claims, 10 Drawing Figures

FIG. 7
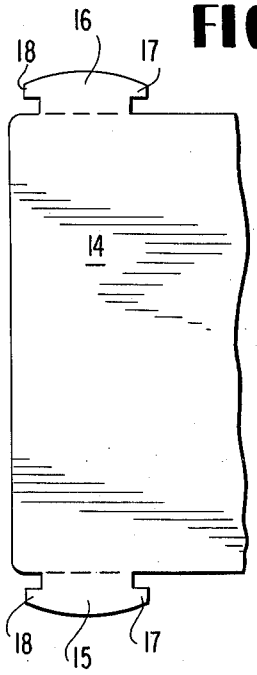
FIG. 6
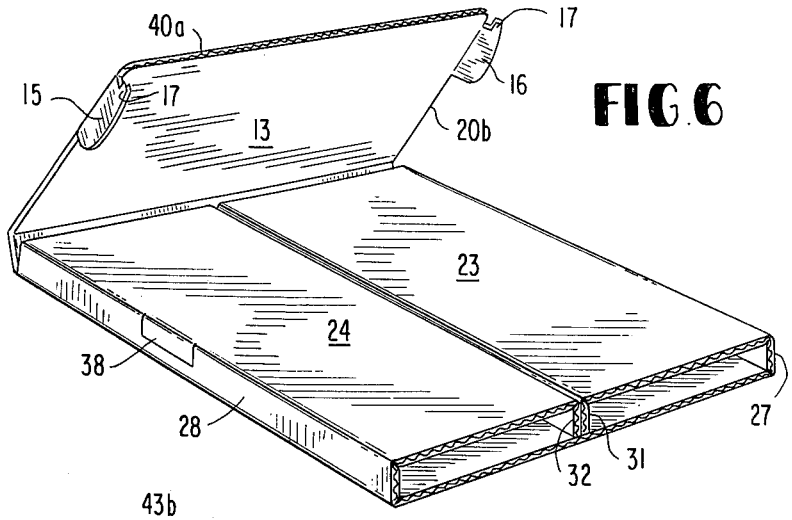
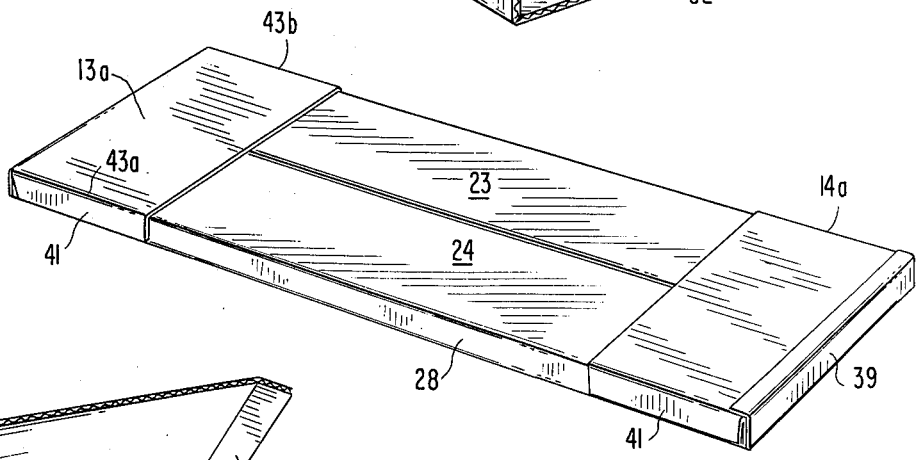
FIG. 8
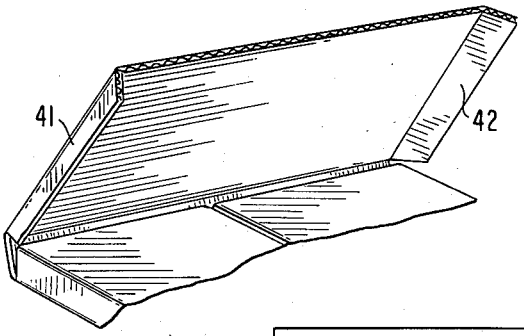
FIG. 9
FIG. 10
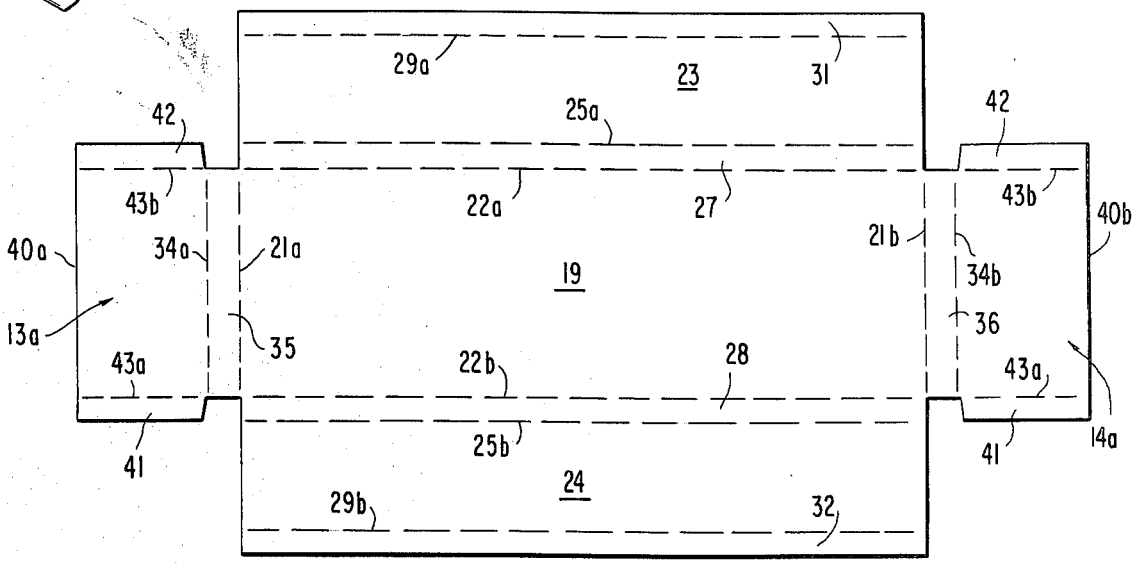

WINDING REEL

BACKGROUND OF THE INVENTION (1) Field of the Invention

The present invention relates in general to winding reels, and more particularly to a reel of novel and advantageous construction for the winding thereupon of web like material, such as cloth or textile fabric. More particularly the invention relates to a reel shaped generally in the configuaration of a thin parallelepiped, and formed from a single sheet of relatively stiff material, such as corrugated cardboard. The cardboard is then formed into a convenient article of use in order that fabric can be conveniently handled, stored or transportated as required.

(2) Description of the Prior Art

It has long been the practice to utilize winding reels in the handling of fabrics and textile materials so that a length of fabric may be wrapped around the winding reel to permit fabric to be easily handled during transport or storage. There has been a number of different configurations of winding reels made from corrugated cardboard material, and these have served the purpose of providing a center for the material, or fabric, but in practice it has been found that these have not proven entirely satisfactory under all conditions of service. Mainly such unsatisfactory service stems from the reason that difficulty has been experienced in preventing the cloth, which has been wound upon the winding reel, from sliding off and unrolling from the board during shipping and handling. A further general deficiency of the previously known winding reels has been the fact that they tend to loose lateral rigidity and collapse due to applied fabric tension upon the reel making the fabric shift upon the reel causing wrinkles, tears, and otherwise providing unsatisfactory support means for the fabric.

SUMMARY OF THE INVENTION

Therefore, it is proposed in the present invention to provide a strong winding reel with means to prevent the cloth wound thereupon from sliding off and unrolling from the board during shipping and handling thereby reducing losses due to damage to the cloth during shipping. Further, the present invention in general provides a winding reel in which the ends of the reel are provided with self-locking flaps eliminating additional steps in the manufacture thereof and wherein these self-locking flaps tend to restrain the cloth from slipping while it is being wound about the reel. The central web stiffening members offer additional lateral rigidity to elimate board collapse due to applied fabric tension and handling. Additional strength is given to the reel by means of cutting the blank from the corrugated cardboard in such a manner that the corrugations are placed in a longitudinal direction parallel to the center line of the reel thus offering additional rigidity against collapse.

A second embodiment of the invention has end flaps in which the securing flap members are glued to the side panels of the reel.

It is, therefore, an object of the present invention to provide an improved winding reel for use in forming a core about which a length of cloth may be wrapped.

Another object of the present invention is the provision of an improved winding reel of sufficient strength to prevent bending or breakage during handling.

A still further object of the invention is the provision of an improved winding reel which is complete in a one piece assembly for both ease of assembly and reduced costs.

Another object of the present invention is a winding reel of improved design having self-locking flap design which offers additional lateral rigidity to eliminate reel collapse due to applied fabric pressure. Such a design additionally offers complete assembly and does not require other parts for fastening.

An additional object of the invention is the provision of a winding reel of corrugated construction in which the corrugations are placed in a longitudinal direction with respect to the center line of the winding reel thereby giving additional rigidity to the reel which prevents collapse and breakage of the reel during normal handling.

Yet another object of the present invention is the provision of the winding reel which is simple and inexpensive to manufacture and may be assembled with the minimum of effort and separate parts.

Other objects and advantages of the present invention will be readily appreciated by those of ordinary skill in the art as the same may be better understood by reference to the following detailed description when considered in connection with the accompanying drawings.

BRIEF DESCRIPTION OF THE DRAWINGS

FIG. 6 is a partial perspective view of the winding reel being folded showing one end flap immediately before being locked into position;

FIG. 7 is a partial plan view of an embodiment showing a second type of locking tab;

FIG. 8 is a perspective view of a second embodiment of the invention showing alternative end flaps;

FIG. 9 is a partial perspective view of the invention shown in FIG. 8 illustrating a type of locking tab designed to be glued to the side panels; and FIG. 10 is a plan view of the embodiment of the invention shown in FIG. 8.

DESCRIPTION OF THE PREFERRED EMBODIMENTS

Figure 1:
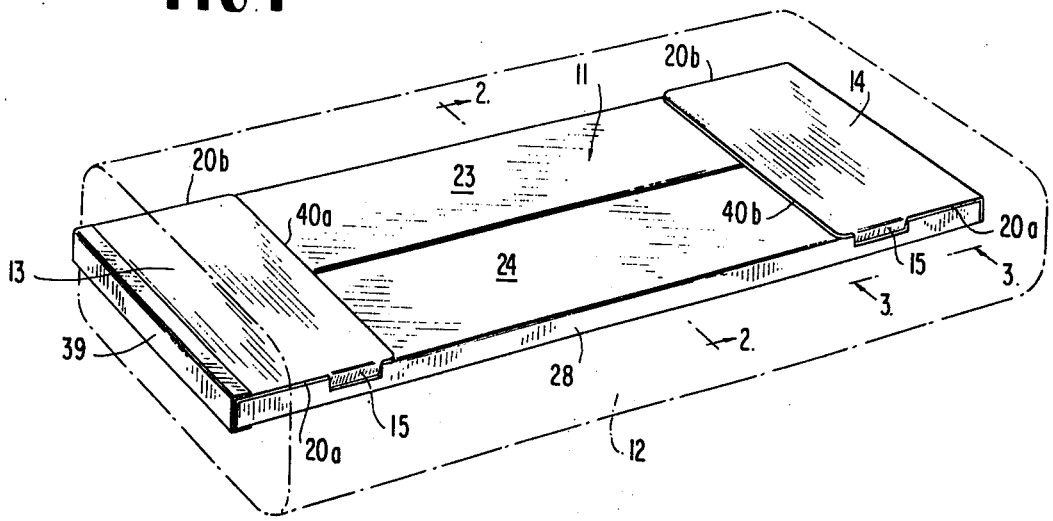
FIG. 1 is an overall prospective view of one embodiment of the improved winding reel of the present invention showing the relationship of fabric being wound thereon in phantom lines.

Referring to the drawings herein like characters designate corresponding parts through the several figures, the winding reel of the present invention is indicated by numeral 11. As shown in FIG. 1 the winding reel is of thin parallelepiped construction forming a unitary box structure which will be described in detail hereinafter.

A bolt of cloth 12 is shown in phantom lines of FIG. 1 wrapped around the winding reel in its normal position.

Figure 5:
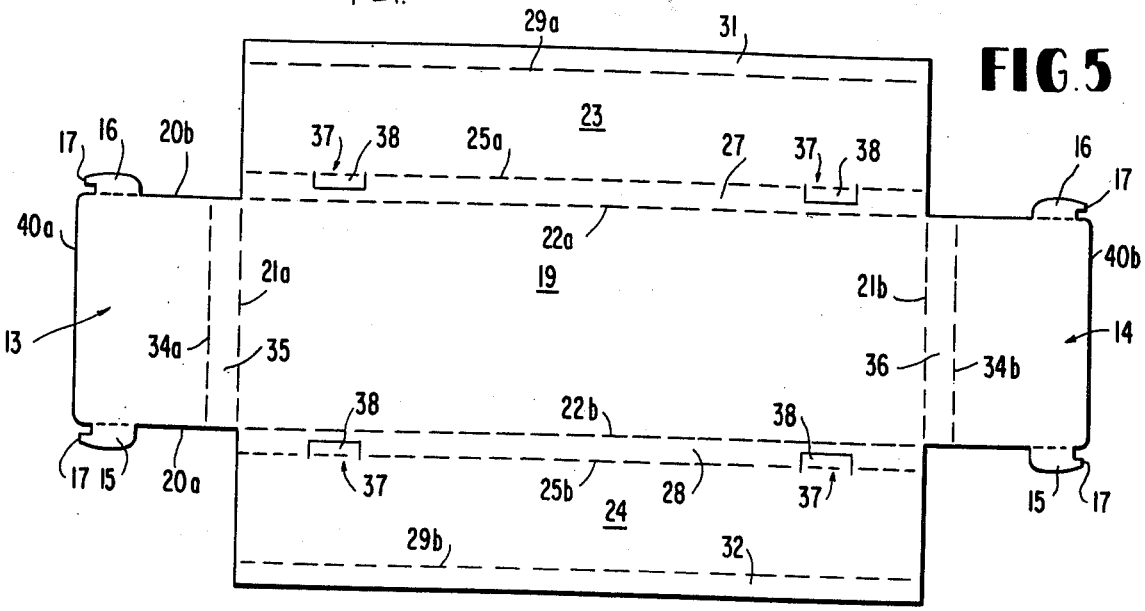
FIG. 5 is a plan view of the winding reel prior to folding.

The winding reel, as can be seen more succinctly in FIGS. 1 and 5, comprises a unitary single piece of corrugated construction which, when folded properly from the flat member of FIG. 5, becomes the winding reel of FIG. 1. Generally, the reel comprises a pair of identical end flaps 13, 14 with each end flap having a pair of locking flaps 15, 16. These flaps project outwardly from each end flap at the side edges thereof as shown by numerals 20*a* and 20*b*, and in order to properly engage the receptacle in which the locking flap will be inserted, there is a tab 17 on each locking flap.

The locking tabs are designed to fit closely to the underneath side of the side wall panels 27 and 28 to thereby assist in positioning the locking flaps within the side wall panel. In addition, the locking tabs obviously retain the locking flaps engaged into the side wall panels.

One edge of each end flap is attached to the bottom wall panel 19 along respective fold lines 21*a* and 21*b* as seen in FIG. 5. The other two edges of the bottom wall panel have attached thereto, at fold lines 22*a* and 22*b*, top wall panels 23 and 24 respectively.

To construct the winding reel 11, the top wall panels 23 and 24 are bent along respective fold lines 22*a* and 22*b* by folding upwardly to a 90° angle and then further bent along fold lines 25*a* and 25*b*, 90° inwardly toward each other thereby forming side wall panels 27 and 28. At this point when the top wall panels are folded, they then lie adjacent one another and form a basic thin parallelepiped box configuration. As is to be noted at this point, each top wall panel has an additional fold line shown by numerals 29*a* and 29*b*, which separate the top wall panel from a first and second central web stiffening member 31 and 32 respectively. An especially important feature of the present invention is the provision of the central web stiffening members 31 and 32 wherein, when they are properly folded along fold lines 29*a* and 29*b*, they project at right angles to the bottom wall panel 19 and the top wall panels 23 and 24 thereby forming a firm support between the respective top and bottom panels. As can be especially seen in FIG. 2, the central web stiffening members bridge the gap between the top and bottom panels and lies in close juxtaposition with one another. Such a construction provides the winding reel with an unusually large degree of longitudinal stiffening to prevent bending due to the applied fabric pressure upon the reel.

Figure 2:
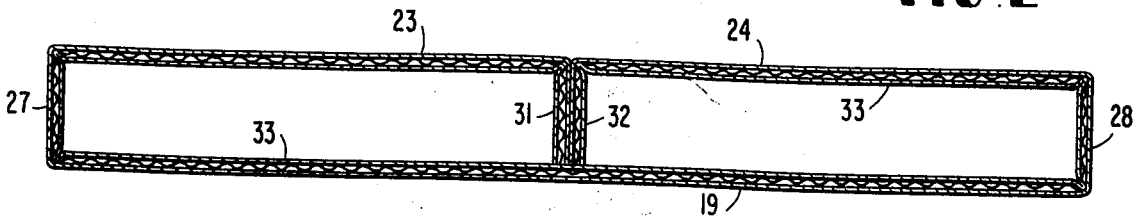
FIG. 2 is a vertical section view of the winding reel taken along lines 2 — 2 of FIG. 1.

In addition, as can be seen also in FIG. 2, the corrugations of the cardboard construction indicated by numeral 33 lie in a longitudinal direction with respect to the center line of the winding reel. Such a placement of the corrugations provides the reel with an added degree of stiffness in a longitudinal direction inasmuch as this is the direction in which the pressure is greatest upon the winding reel and consequently reels of the prior art have tended to collapse or bend due to the applied pressure in a transverse direction to the longitudinal center line. The combination of the corrugations and the central web stiffening members are designed to prevent such breakage.

Figure 3:
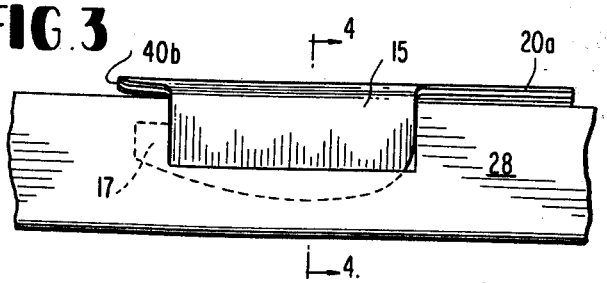
FIG. 3 is a partial vertical view taken along lines 3 — 3 of FIG. 1 showing the locking flaps in locking position.
Figure 4:
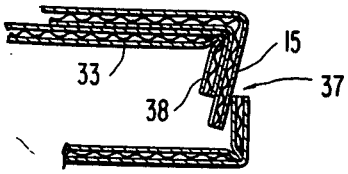
FIG. 4 is a vertical section view taken along lines 4 — 4 of FIG. 3 showing a different view of the locking flaps.

To complete the construction of the winding reel, the end flaps 13 and 14 are folded along their respective fold lines 21*a* and 21*b*, 90° and then once again folded along a second set of fold lines 34*a* and 34*b* inwardly toward one another thereby forming respective end panels 35 and 36. After being folded along both fold lines 21*a*, 21*b* and 34*a*, 34*b*, each end flap then lies atop the top wall panels 23 and 24 with the respective locking flaps 15 and 16 overlying identical locking flap slots 37. In the embodiment as shown in the present figures and particularly as shown in FIGS. 3 and 4, the locking flap slot is normally closed until the locking flaps are inserted therein. When the locking flaps are inserted downwardly into the locking flap slots 37, the slot closure flap 38 is pushed in into the interior of the winding reel and it then thereby impinges and maintains a compression fit against the locking flap so that the flap maintains a relationship against the side wall panels 27 and 28. FIGS. 3 and 4 show the relationship of the locking flaps and slot closure flaps when in operative position. Such a construction provides additional rigidity to the winding reel to bending moments placed upon the winding reel since no slits or openings are placed in a transverse direction in the top wall panels 23 and 24 which would tend to weaken these panels.

The fabric 12 is kep from sliding off the reel by the provision of distal edges 40*a* and 40*b* of their respective end flaps. As is evident, the distal edges are somewhat sharply cut during manufacture and these edges engage the tightly wound fabric and maintain it in a stable non-shifting position.

Once the construction has been completed as shown in FIG. 1, the manufacturer, or user, may place upon one end an identifying label 39 which would normally identify the manufacturer and type of goods placed upon the winding reel.

As was noted previously, each of the locking flaps 15 and 16 have a tab 17 projecting from the flap which will help maintain the flap in locking relationship within the locking flap slot 37. It has been found that at times due to various users requirements a more secure locking system might be desired. Referring now to FIG. 7, it is seen that the locking flaps have an additional tab located thereon identified by numeral 18. In this particular embodiment, the locking flaps therefore have tabs 17 and 18 to provide a more secure locking mechanism.

In yet another embodiment of the invention as depicted in FIGS. 8, 9 and 10, there is shown a modified locking flap upon each of the end flaps 13*a* and 14*a*. It has been found that some users prefer not to use a locking tab system as described on the embodiment of FIG. 1 and would prefer, however, to utilize a locking flap which is glued to the structure as a whole. Consequently, as depicted in the later Figures, there is provided a locking flaps 41 and 42 which are attached to the side edges 43*a* and 43*b* respectively. In this particular embodiment, the side edges 43*a* and 43*b* now become fold lines. In other respects the winding reel remains the same as that previously described with the exception that once the end flaps 13*a* and 14*a* are folded to lie in juxtaposition with top wall panels 23 and 24, the locking tabs 41 and 42 would then lie along side the side wall panels 27 and 28. The winding reel would normally be manufactured by sending it through a glue machine which would apply a bead of glue to the undersurface of the locking tabs 41 and 42 and then these tabs would be pressed to the side walls 27 and 28 thereby affixing the tabs to the winding reel and providing a unitary structure. For convenience sake, the reference characters as applied to the first embodiment shown by FIG. 1 are maintained throughout the embodiment shown in FIGS. 8, 9 and 10 with the exception of the renumbering of the end flaps 13*a* to 14*a*, locking flaps 41, 42 and the fold line or side edge 43*a*, 43*b*. From this embodiment, it is seen that no appertures or slots have been cut into the winding reel thereby even further strengthening the reel for heavy duty use.

As is evident from the construction of the present invention, there has been provided a unitary winding reel of such construction that it can be easily fabricated by machine to form a self-locking structure or increased rigidity and crush resistance to the applied fabric which is designed to be wound therearound.

Why I have particularly shown and described several embodiments of the present invention, it is distinctly understood that the invention is not limited thereto but that modifications may be made within the scope of the invention in such variations as are covered by the scope of the appended claims.

What is claimed is:

1. A winding reel of relatively stiff material for use as a core comprising:

(a) an elongated rectangular thin parallelepiped box-like structure with interconnected top, bottom and side wall panels formed of a single piece of corrugated material with integral end flaps having locking flaps affixed thereto, (b) the bottom panel having a pair of opposed side edges, first and second side wall panels foldably attached to said bottom panel along respective fold lines to the opposed side edges, the first and second side wall panels having a pair of opposed side edges spaced from and parallel to the respective side edges of the bottom wall panel, the side wall panels being folded to an interior angle such that the side wall panels project perpendicularly to the bottom wall panel, the bottom wall panel having a pair of opposed end edges, (c) first and second top wall panels foldably attached to the respective opposed edges of the side wall panels along respective fold lines, the top wall panels being folded to an interior angle such that the top wall panels project perpendicularly to the side wall panels and parallel to the bottom wall panel, each top wall panel having an edge lying in juxtaposition with one another forming a longitudinal center line of the reel, (d) each of said top wall panel edges having a central web stiffening member attached thereto, each of said central web stiffening members being folded inwardly to project perpendicularly to the bottom wall panel and to lie adjacent thereto providing a predetermined spacing between the top wall panels and the bottom wall panel and serving to reinforce the reel against crushing forces applied perpendicularly to the reel, (e) first and second end flaps having a proximal edge, a distal edge and opposed side edges, each end flap being foldably connected at the proximal thereof to a respective end edge of the bottom wall panel, each end flap having an end panel formed therein of such dimensions as to overlie the space confined within an area defined by the interconnected top, a portion of the end flap further overlying and being in juxtaposition with the top wall panels, (f) the corrugations of the corrugated material being aligned with the longitudinal center line of the reel as formed by the edges of the top wall panels lying in juxtaposition with one another, (g) each end flap having locking means integral therewith to maintain the winding reel in said box-like structure, wherein the locking means comprise a locking flap overlying and permanently affixed to the respective side wall panel, each locking flap being located only on the respective opposed edge of the end flap associated therewith whereby, when the locking means engage the side wall panels a unitary structure is thereby formed.

2. The winding reel as claimed in claim 1, wherein each locking flap is permanently glued to the side wall panel.

3. A winding reel of relatively stiff material for use as a core comprising:

(a) an elongated rectangular thin parallelepiped box like structure with interconnected top, bottom and side wall panels formed of a single piece of corrugated material with integral end flaps having locking flaps affixed thereto, (b) the bottom panel having a pair of opposed side edges, first and second side wall panels foldably attaches to said bottom panel along respective fold lines to the opposed side edges, the first and second side wall panels having a pair of opposed side edges spaced from and parallel to the respective side edges of the bottom wall panel, the side wall panels being folded to an interior angle such that the side wall panels project perpendicularly to the bottom wall panel, each side wall panel having a locking flap slot therein located parallel to the longitudinal center line of the reel, (c) first and second top wall panels foldably attached to the respective opposed edges of the side wall panels along respective fold lines, the top wall panels folded to an interior angle such that the top wall panels project perpendicularly to the side wall panels and parallel to the bottom wall panel, each top wall panel having an edge lying in juxtaposition with one another forming a longitudinal center line of the reel, (d) each of said top wall panel edges having a central web stiffening member attached thereto, each of said central web stiffening members being folded inwardly to project perpendicularly to the bottom wall panel and to lie adjacent thereto providing a predetermined spacing between the top wall panels and the bottom wall panel and serving to reinforce the reel against crushing forces applied perpendicularly to the reel, (e) first and second end flaps having a proximal edge, a distal edge and opposed side edges, each end flap being foldably connected at the proximal edge thereof to a respective end edge of the bottom wall panel, each end flap having an end panel formed therein of such dimensions as to overlie the space confined within an area defined by the interconnected top, a portion of the end flap further overlying and being in juxtaposition with the top wall panels, (f) the corrugations of the corrugated material being aligned with the longitudinal center line of the reel as formed by the edges of the top wall panels lying in juxtaposition with one another, (g) the opposed side edges of each end flap having locking means engaging with the locking flap slot, wherein the locking means comprise at least one locking flap to engage the locking flap slot, said locking flap being folded and projecting into the respective locking flap slot located in the respective side wall panel, said interlock means comprises a locking tab, and wherein each locking flap has at least one locking tab projecting therefrom and interlocking against one side wall panel through which the locking flap projects, biasing means integral with the locking flap slot exerting a positioning force on the locking flap to thereby retain the locking flap positioned against the side wall panel, (h) whereby, when the locking means engage the side wall panels a unitary structure is thereby formed.

* * * * *